US012262762B2

(12) United States Patent
Fink

(10) Patent No.: US 12,262,762 B2
(45) Date of Patent: Apr. 1, 2025

(54) UNDERWIRE FOR BRASSIERE

(71) Applicant: S&S Industries Limited, Cheung Sha Wan (CN)

(72) Inventor: Matthew Fink, Weston, MA (US)

(73) Assignee: S&S Industries Limited, Cheung Sha Wan (CN)

( * ) Notice: Subject to any disclaimer, the term of this patent is extended or adjusted under 35 U.S.C. 154(b) by 9 days.

(21) Appl. No.: 18/209,102

(22) Filed: Jun. 13, 2023

(65) Prior Publication Data

US 2024/0415209 A1 Dec. 19, 2024

(51) Int. Cl.
*A41C 3/12* (2006.01)

(52) U.S. Cl.
CPC ..... *A41C 3/122* (2013.01)

(58) Field of Classification Search
CPC ..... A41C 3/122; A41C 1/14
USPC ..... 450/51
See application file for complete search history.

(56) References Cited

U.S. PATENT DOCUMENTS

| | | | | |
|---|---|---|---|---|
| 495,618 | A | 4/1893 | Warner | |
| 540,067 | A | 5/1895 | Linscott | |
| 1,061,081 | A | 5/1913 | Johnson | |
| 2,782,417 | A | 11/1955 | Magidson | |
| 3,035,584 | A | 5/1962 | Menkel | |
| 3,140,494 | A | 7/1964 | Magidson | |
| 3,312,223 | A * | 4/1967 | Wilson | A41C 3/124 450/45 |
| 3,747,606 | A * | 7/1973 | Tareau | A41C 3/122 2/257 |
| 4,235,240 | A * | 11/1980 | Cousins | A41C 3/122 450/52 |
| 4,770,650 | A | 9/1988 | Rowell | |
| 6,106,363 | A | 8/2000 | Werner | |
| 6,468,130 | B1 | 10/2002 | Thakur et al. | |
| 6,575,811 | B1 | 6/2003 | Fildan et al. | |
| 6,761,613 | B2 * | 7/2004 | Utaka | A41C 3/124 450/41 |

(Continued)

FOREIGN PATENT DOCUMENTS

WO 2019165061 A1 8/2019

OTHER PUBLICATIONS

Written Opinion of the International Searching Authority in PCT/US2024/033740 (Oct. 9, 2024).
International Search Report in PCT/US2024/033740 (Oct. 9, 2024).

*Primary Examiner* — Timothy K Trieu
(74) *Attorney, Agent, or Firm* — Pryor Cashman LLP

(57) ABSTRACT

An underwire for use in a brassiere, and an associated brassiere, including a generally arcuate base member and first and second support members, each support member having a length shorter than the length of the base member, the first and second support members disposed on and fixedly attached to the base member along the central portion of the base member, spaced from the opposed first and second end portions, and on opposite sides of the base member from each other, where the first support member and the second support member are fixedly attached to the base member by a plurality of riveted joints, and where the opposed first and second end portions of the base member have a greater flexibility than a flexibility of the central portion of the base member having the first support member and the second support member fixedly attached thereto.

20 Claims, 3 Drawing Sheets

(56) References Cited

U.S. PATENT DOCUMENTS

| | | | | |
|---|---|---|---|---|
| 6,857,933 | B2 * | 2/2005 | Horta | A41C 3/0007 450/52 |
| 7,112,117 | B2 * | 9/2006 | Horta | A41C 3/122 2/259 |
| 7,850,507 | B2 * | 12/2010 | Horta | A41C 3/126 450/41 |
| 9,179,714 | B2 * | 11/2015 | Lau | A41C 3/124 |
| 9,775,383 | B1 | 10/2017 | Charnecky | |
| 10,016,000 | B2 | 7/2018 | Cheung | |
| 2007/0264905 | A1 * | 11/2007 | Horta | A41C 3/124 450/41 |
| 2011/0124268 | A1 | 5/2011 | Cheng | |
| 2012/0052769 | A1 | 3/2012 | Pearce et al. | |
| 2013/0137340 | A1 | 5/2013 | Liu | |
| 2013/0295819 | A1 * | 11/2013 | Liang | A41C 3/12 450/41 |
| 2019/0261701 | A1 | 8/2019 | Fink | |

* cited by examiner

UNDERWIRE FOR BRASSIERE

TECHNICAL FIELD

The present invention relates generally to underwires, and particularly to underwires used in foundation garments such as brassieres.

BACKGROUND OF THE INVENTION

Underwires are components used to provide shape and support to brassieres and similar foundation garments. Underwires are typically rigid and flat, formed of steel, and have an arcuate configuration. Alternatively, underwires may be formed of hard, molded, or extruded plastic. Metal, plastic, or polymeric tips are often provided at one or both ends of the underwires.

When a garment having an underwire is worn, certain movements of the wearer, including turning, twisting, and bending of the torso, can cause the underwire to press into the wearer's body and cause discomfort. There is a need for an improved underwire that provides the requisite level of shape and support, but also permits greater flexibility to lessen the pressing effects of the underwire.

SUMMARY OF THE INVENTION

In general, in one aspect, the invention features an underwire for use in a brassiere including a generally arcuate base member having a first side, a second side opposed from the first side, and a length including a central portion and opposed first and second end portions; a first support member having a length shorter than the length of the base member, the first support member disposed on and fixedly attached to the first side of the base member along the central portion of the base member and spaced from the opposed first and second end portions; and a second support member having a length shorter than the length of the base member, the second support member disposed on and fixedly attached to the second side of the base member along the central portion of the base member and spaced from the opposed first and second end portions, where the first support member and the second support member are fixedly attached to the base member by a plurality of riveted joints, and where the opposed first and second end portions of the base member have a greater flexibility than a flexibility of the central portion of the base member having the first support member and the second support member fixedly attached thereto.

Implementations of the invention may include one or more of the following features. The base member may include steel, stainless steel, or alloy steel. One or both of the first support member and the second support member may include steel, stainless steel, or alloy steel. The first support member and the second support member may be fixedly attached to each other by the plurality of riveted joints. The plurality of riveted joints may be three riveted joints, and a first riveted joint may be disposed at a more central portion on the underwire, a second riveted joint may be disposed at a first end of the first support member and the second support member, and a third riveted joint may be disposed at a second end of the first support member and the second support member. A tip may be disposed on one or both of the opposing first and second end portions of the base member, and the tip may be formed of plastic or polymer. The underwire may further include a coating disposed on the base member, the first support member, and the second support member. The length of each of the first support member and the second support member may be approximately half the length of the base member.

In general, in another aspect, the invention feature a brassiere including at least one underwire including a generally arcuate base member having a first side, a second side opposed from the first side, and a length including a central portion and opposed first and second end portions; a first support member having a length shorter than the length of the base member, the first support member disposed on and fixedly attached to the first side of the base member along the central portion of the base member and spaced from the opposed first and second end portions; and a second support member having a length shorter than the length of the base member, the second support member disposed on and fixedly attached to the second side of the base member along the central portion of the base member and spaced from the opposed first and second end portions, where the first support member and the second support member are fixedly attached to the base member by a plurality of riveted joints, and where the opposed first and second end portions of the base member have a greater flexibility than a flexibility of the central portion of the base member having the first support member and the second support member fixedly attached thereto.

Implementations of the invention may include one or more of the following features. The base member may include steel, stainless steel, or alloy steel. One or both of the first support member and the second support member may include steel, stainless steel, or alloy steel. The first support member and the second support member may be fixedly attached to each other by the plurality of riveted joints. The plurality of riveted joints may be three riveted joints, and a first riveted joint may be disposed at a more central portion on the underwire, a second riveted joint may be disposed at a first end of the first support member and the second support member, and a third riveted joint may be disposed at a second end of the first support member and the second support member. A tip may be disposed on one or both of the opposing first and second end portions of the base member, and the tip may be formed of plastic or polymer. The underwire may further include a coating disposed on the base member, the first support member, and the second support member. The length of each of the first support member and the second support member may be approximately half the length of the base member.

BRIEF DESCRIPTION OF THE DRAWINGS

The above-mentioned and other aspects, features, and advantages can be more readily understood from the following detailed description with reference to the accompanying drawings wherein.

DETAILED DESCRIPTION OF THE INVENTION

The present invention provides an underwire for use in foundation garments including, but not limited to, brassieres. In a preferred embodiment, the underwire includes a generally planar base member, or primary wire, and at least two support members, or stiffening wires, fixedly attached to the base member, particularly at least one support member being disposed on an opposite side of the base member from the at least one other support member. The base member may be curved so as to be generally arcuate. In particular, the support members may be curved to mirror the portion of the base member to which they are attached. The support members may have a length shorter than a length of the base member, and may be attached to a central portion of the base member. In this configuration, one or both end portions of the base member have greater flexibility as compared to the central portion of the base member having the attached support members. Notably, in this arrangement, the end portions of the base member are more flexible in a direction perpendicular to the plane in which the base member lies.

Figure 1:
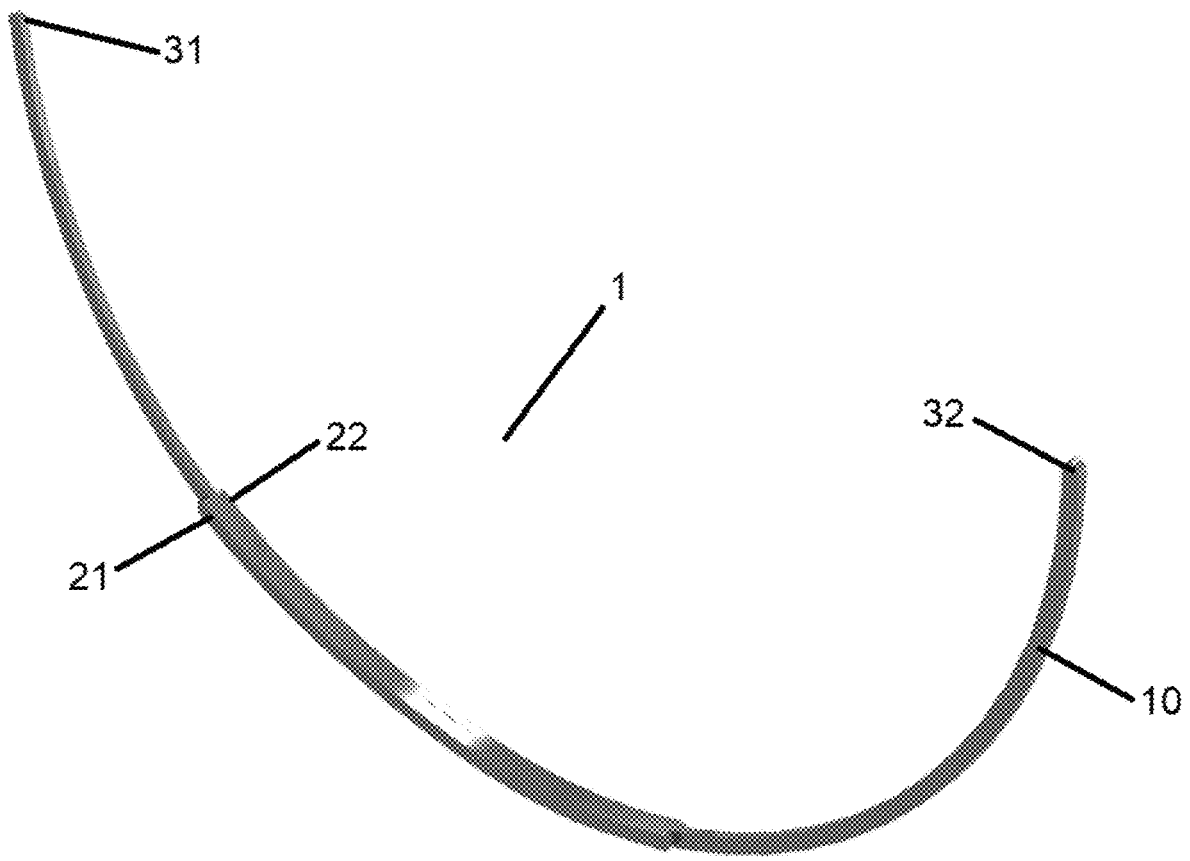
FIG. 1 shows a perspective view of an underwire according to an embodiment of the present invention.
Figure 2:
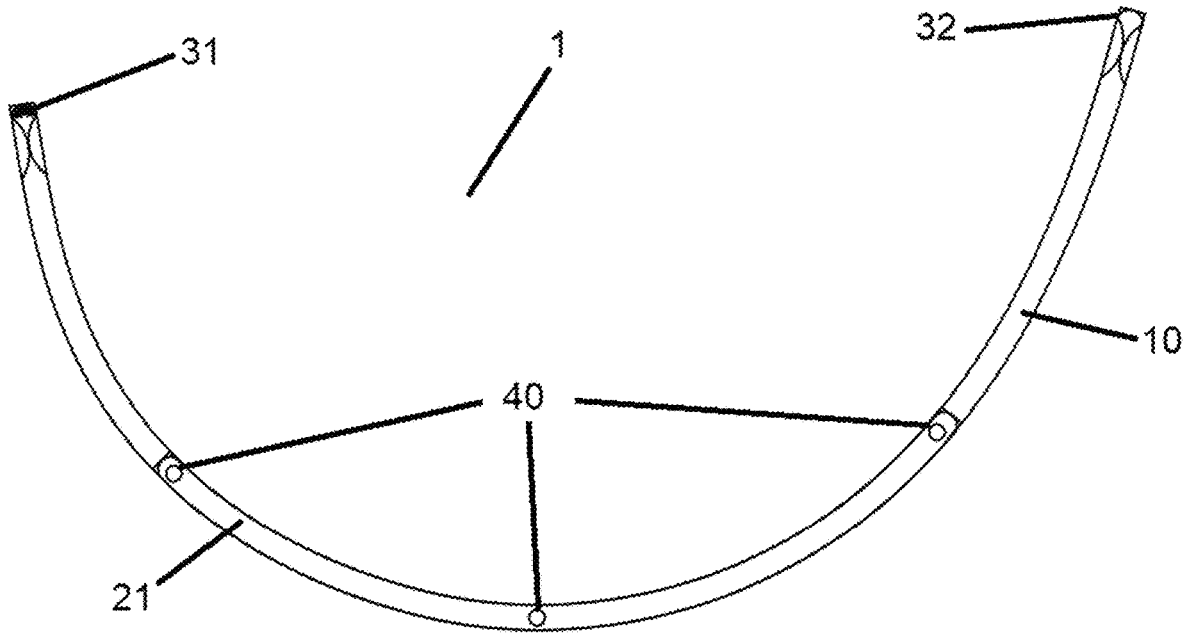
FIG. 2 shows a front view of an underwire according to another embodiment of the present invention.
Figure 3:
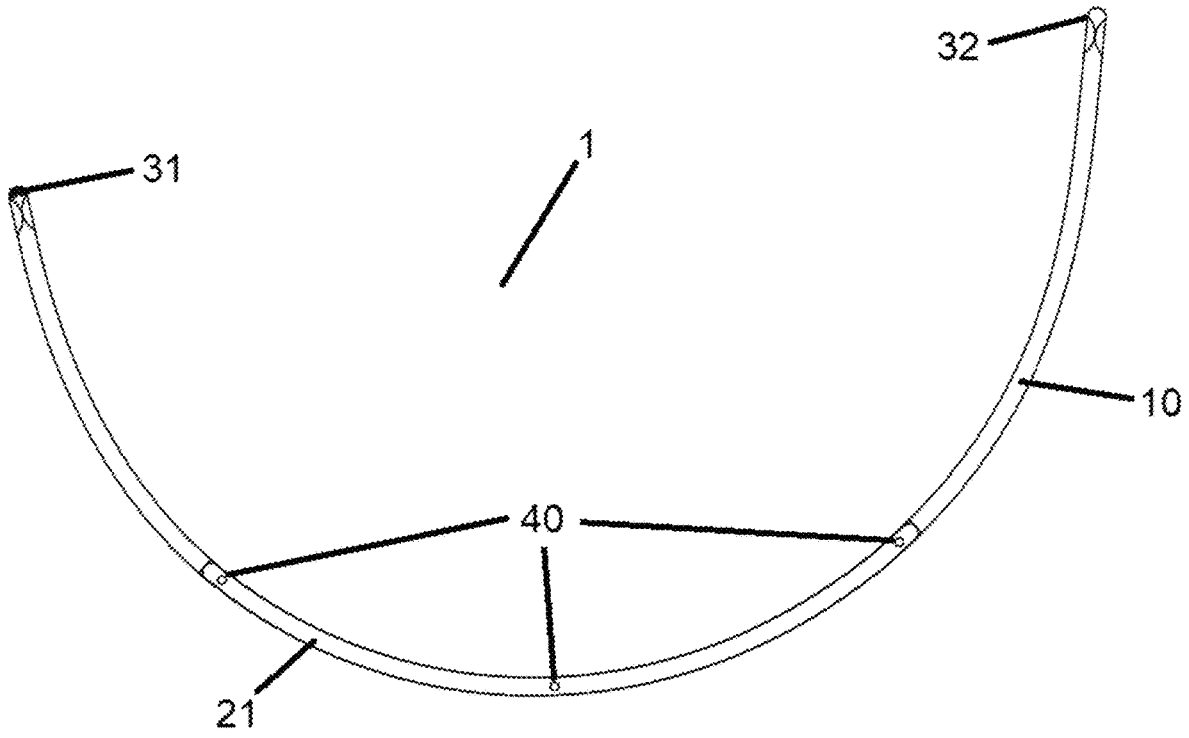
FIG. 3 shows a front view of an underwire according to another embodiment of the present invention.

In the embodiments of FIGS. 1-3, an underwire 1 includes a base member 10, a first support member 21, a second support member 22, a first tip 31, and a second tip 32. Base member 10 is generally flat with a rounded edge or oval-shaped cross-section, and curved to generally have an arcuate shape. Base member 10 may be formed of a metal or metal alloy, such as steel, stainless steel, or alloy steel.

First support member 21 and second support member 22 are also generally flat with a rounded edge or oval-shaped cross-section, and curved in the same or similar manner as base member 10 for the portion of base member 10 on which first support member 21 and second support member 22 are disposed. In this embodiment, the length of each of first support member 21 and second support member 22 is approximately half the length of base member 10. In alternative embodiments, the length of each of first support member 21 and second support member 22 may vary so as to be shorter and disposed on a more central portion of base member 10, or to be longer and extended further toward first tip 31 and second tip 32. First support member 21 and second support member 22 may also be formed of a metal or metal alloy, such as steel, stainless steel, or alloy steel. In these embodiments, two support members, first support member 21 and second support member 22, are included in the underwire 1, and accordingly, the support members are disposed on opposite sides of base member 10, with first support member 21 being disposed on a first side of base member 10 and second support member 22 being disposed on a second side of base member 10.

First tip 31 is disposed on a first end of base member 10, and second tip 32 is disposed on a second end of base member 10. First tip 31 and second tip 32 may have rounded outer edges and a thickness greater than base member 10. In alternative embodiments, underwire 1 may only include one or none of first tip 31 and second tip 32. One or both of first tip 31 and second tip 32 may be formed of a plastic or polymeric material.

In a preferred embodiment, first support member 21 and second support member 22 may be fixedly attached to base member 10 and/or to each other through the use of riveted joints 40, e.g., using rivets. In a further preferred embodiment, three riveted joints 40 are employed in affixing first support member 21 and second support member 22 to base member 10, namely one riveted joint at a more central portion on underwire 1, base member 10, first support member 21, and second support member 22, one riveted joint on a first end of first support member 21 and second support member 22, and one riveted joint on a second end of first support member 21 and second support member 22. In the present invention, the use of riveted joints is superior to other known attachment techniques, e.g., welding, due to its associated commercial workability while simultaneously providing both sufficient securement and flexibility of the constructed underwire.

In the embodiments of the present invention, including those described in FIGS. 1-3, the underwire may be encapsulated in or covered by a coating. The coating may be disposed on the base member-support members assembly to cover the assembly. The same or different coating may be disposed on the tips incorporated with the underwire to cover the incorporated tips. The selected coating may be any industry-accepted coating including, but not limited to, a nylon coating.

The embodiments and examples above are illustrative, and many variations can be introduced to them without departing from the spirit of the disclosure or from the scope of the appended claims. For example, elements and/or features of different illustrative and exemplary embodiments herein may be combined with each other and/or substituted with each other within the scope of this disclosure. The objects of the invention, along with various features of novelty that characterize the invention, are pointed out with particularity in the claims annexed hereto and forming a part of this disclosure. For an understanding of the invention, its operating advances and the specific objects attained by its uses, reference should be had to the accompanying drawings and descriptive matter in which there is illustrated a preferred embodiment of the invention.

What is claimed is:

1. An underwire for use in a cup of a brassiere, comprising:

a generally arcuate base member having a first side, a second side opposed from the first side, and a length including a central portion, a first end portion, and a second end portion opposed from the first end portion;

a first support member having a length shorter than the length of the base member, the first support member disposed on and fixedly attached to the first side of the base member along the central portion of the base member and spaced from the first and second end portions; and a second support member having a length shorter than the length of the base member, the second support member disposed on and fixedly attached to the second side of the base member along the central portion of the base member and spaced from the first and second end portions;

wherein the first support member and the second support member are fixedly attached to the base member by a plurality of riveted joints; and wherein the first and second end portions of the base member have a greater flexibility than a flexibility of the central portion of the base member having the first support member and the second support member fixedly attached thereto.

2. The underwire of claim 1, wherein the base member comprises steel, stainless steel, or alloy steel.

3. The underwire of claim 1, wherein one or both of the first support member and the second support member comprises steel, stainless steel, or alloy steel.

4. The underwire of claim 1, wherein the first support member and the second support member are fixedly attached to each other by the plurality of riveted joints.

5. The underwire of claim 1, wherein the plurality of riveted joints are three riveted joints.

6. The underwire of claim 5, wherein a first riveted joint is disposed at a more central portion on the underwire, a second riveted joint is disposed at a first end of the first support member and the second support member, and a third riveted joint is disposed at a second end of the first support member and the second support member.

7. The underwire of claim 1, wherein a tip is disposed on one or both of the first and second end portions of the base member.

8. The underwire of claim 7, wherein the tip is formed of plastic or polymer.

9. The underwire of claim 1, further comprising a coating disposed on the base member, the first support member, and the second support member.

10. The underwire of claim 1, wherein the length of each of the first support member and the second support member is approximately half the length of the base member.

11. A brassiere having a first cup, comprising:

a first underwire for use in the first cup of the brassiere, comprising:

a generally arcuate base member having a first side, a second side opposed from the first side, and a length including a central portion, a first end portion, and a second end portion opposed from the first end portion;

a first support member having a length shorter than the length of the base member, the first support member disposed on and fixedly attached to the first side of the base member along the central portion of the base member and spaced from the first and second end portions; and a second support member having a length shorter than the length of the base member, the second support member disposed on and fixedly attached to the second side of the base member along the central portion of the base member and spaced from the first and second end portions;

wherein the first support member and the second support member are fixedly attached to the base member by a plurality of riveted joints; and wherein the first and second end portions of the base member have a greater flexibility than a flexibility of the central portion of the base member having the first support member and the second support member fixedly attached thereto.

12. The brassiere of claim 11, wherein the base member comprises steel, stainless steel, or alloy steel.

13. The brassiere of claim 11, wherein one or both of the first support member and the second support member comprises steel, stainless steel, or alloy steel.

14. The brassiere of claim 11, wherein the first support member and the second support member are fixedly attached to each other by the plurality of riveted joints.

15. The brassiere of claim 11, wherein the plurality of riveted joints are three riveted joints.

16. The brassiere of claim 15, wherein a first riveted joint is disposed at a more central portion on the underwire, a second riveted joint is disposed at a first end of the first support member and the second support member, and a third riveted joint is disposed at a second end of the first support member and the second support member.

17. The brassiere of claim 11, wherein a tip is disposed on one or both of the first and second end portions of the base member.

18. The brassiere of claim 17, wherein the tip is formed of plastic or polymer.

19. The brassiere of claim 11, further comprising a coating disposed on the base member, the first support member, and the second support member.

20. The brassiere of claim 11, wherein the length of each of the first support member and the second support member is approximately half the length of the base member.

* * * * *